United States Patent [19]

McSpadden

[11] 4,202,245

[45] May 13, 1980

[54] SHELL RELOADER WITH AUTOMATIC EJECTION

[76] Inventor: Larry W. McSpadden, P.O. Box 343, Mountain View, Ak. 72560

[21] Appl. No.: 892,651

[22] Filed: Apr. 3, 1978

[51] Int. Cl.[2] ..... F42B 33/10

[52] U.S. Cl. ..... 86/36; 86/23

[58] Field of Search ..... 86/36, 23, 24

[56] References Cited

U.S. PATENT DOCUMENTS

| | | | |
|---|---|---|---|
| 2,398,293 | 4/1946 | Dorothea et al. | 86/36 |
| 3,259,007 | 7/1966 | Havourd et al. | 86/36 |
| 3,283,643 | 11/1966 | Mittelsteadt | 86/36 |
| 3,320,848 | 5/1967 | Ponsness | 86/38 |
| 3,322,020 | 5/1967 | Eckert | 86/23 |
| 3,979,995 | 9/1976 | Phillips | 86/23 |

FOREIGN PATENT DOCUMENTS

| | | | |
|---|---|---|---|
| 15522 | of 1897 | United Kingdom | 86/36 |

*Primary Examiner*—Edward A. Miller
*Attorney, Agent, or Firm*—Bernard & Brown

[57] ABSTRACT

An automatically-ejecting shell reloading device is provided for handling spent firearm cartridge shells. The apparatus may include a die assembly mounted to receive an upwardly thrust shell. A cylindrical ram element having an upper C-shaped retainer is adapted to receive and hold a vertically-aligned shell, and the device has means for moving the ram element into an upper position, an intermediate shell-receiving position, and a lower shell-ejecting position. An ejection spring is deflected outwardly by the ram element in the intermediate position and is urged against the shell in the lower position to eject the shell laterally from the ram element. In a preferred embodiment, ejection is achieved after resizing by a leaf ejection spring mounted for lateral deflecting movement by the ram element. The device is useful for handling cartridge cases during swaging, depriming, and priming operations.

6 Claims, 7 Drawing Figures

SHELL RELOADER WITH AUTOMATIC EJECTION

This invention relates to reloading of spent firearm cartridge shells. In particular it relates to techniques and apparatus for resizing a cartridge shell employing a die assembly and a press mechanism for engaging and retracting the shell from the die assembly during the reloading operations.

Reloading tools are employed for pistol arm rifle cartridge cases or shells where the ammunition is to be reused. A typical reloading tool includes a press frame-for holding sizing and forming dies, with reciprocal plunger or ram which retains and forces the case into suitable resizing die or for swaging bullets. Such reloading tools may also include an extractor machanism for removing expended primer caps and a device for reinserting new primers into the cartridge shell. Reloading is ordinarily a manual operation carried out by the hobbyist or marksman in order to permit reuse of the expensive metal shell portion of the cartridge.

Several mechanical operations may be employed during reloading of a cartridge. These operations include full-length resiziing, decapping, inside neck expanding, priming, charging of powder, and bullet seating and crimping.Most of these operations can be carried out in a single reloading tool with appropriate reloading die assemblies. In the ordinary reloading sequence, the cartridge shell is placed onto a reciprocal plunger or bidirectional ram having a shell holding means disposed theron. Resizing dies are ordinarily mounted adjacent the top portion of the reloading press frame and the shell is forced upwardly into the resizing dies by a manually-operated lever operatively connected to the reciprocal ram. The spent primer cap may be removed with the same upward movement by a pin associated with the die assembly and moved to a lower position where it may be removed manually from the tool.

In order to improve the efficiency of the reloading operation, a novel cartridge shell press with automatic shell ejection is provided by the present invention. The device includes a generally vertically-aligned frame member having a lateral access opening, an upper shell-receiving portion, and a lower ram receiving portion. A die assembly is mounted on the frame adjacent the shell-receiving portion, aligned to receive a shell thrust upwardly through the shell-receiving portion. A vertically-movable ram means is provided for moving the shell along a travel path into engagement with the die assembly and adapted for holding a shell member. A bidirectional power delivery means moves the ram means upwardly from an intermediate shell engagement position toward an upper die position and downwardly toward a lower shell ejection position.

Automatic ejection of the shell is effected by spring means mounted on or otherwise associated with, the frame and extending into the lateral access opening into the travel path of the shell. The spring is deflected outwardly by the ram means in the intermediate shell engagement position and adapted for spring return into the travel path when the ram means is retracted to the lower ejection position, thereby providing positive spring ejection of a cartridge shell when fully retracted from the upper die position to the lower ejection position.

The die assembly is adapted for resizing a cartridge shell and may be provided with means for removing a primer cap cooperatively with resizing.

The spring means may be mounted on the frame or other member by a mounting bracket fixed between said frame and said die assembly. In a preferred embodiment, the spring means comprises a leaf spring member attached to the frame by a mounting bracket and depending from the upper portion of the frame member into the lateral access opening. As an additional feature, the press may include a primer cap deflector mounted adjacent the lower ram receiving portion of the frame. The primer cap deflector may be held in place by the primer arm assembly (not shown) if desired. A conventional ram has a passage permitting primer caps to fall from the shell downwardly to the deflector member during the resizing operation.

The present invention may be employed to eject the shell in association with a resizing or swaging operation alone or in combination with other operations. For instance, in U.S. Pat. No. 3,259,007 (incorporated herein by reference), a reloading tool is adapted for extracting a spent primer and inserting a new primer in the same device. Such tools may be modified to include the present shell ejection spring means. Special care should be taken in handling resized and reprimed cartridges to prevent accidental discharge.

Other conventional shell reloading devices such as priming apparatus may also employ the novel shell ejection spring mechanism. The reciprocating plunger or bidirectional ram action is common to various shell loading apparatus. In modifying conventional apparatus, the upper end of the ram may be provided with a removable or interchangeable shell holder that fits around the rim of the cartridge case, while permitting lateral movement of the case during placement and ejection.

Also it is an object of the present invention to provide automatic ejection of the reformed shell and to eliminate the time-consuming manual shell-retrieval step. These and other objects and features of the invention will be seen by the following description and in the drawings wherein.

Figure 1:
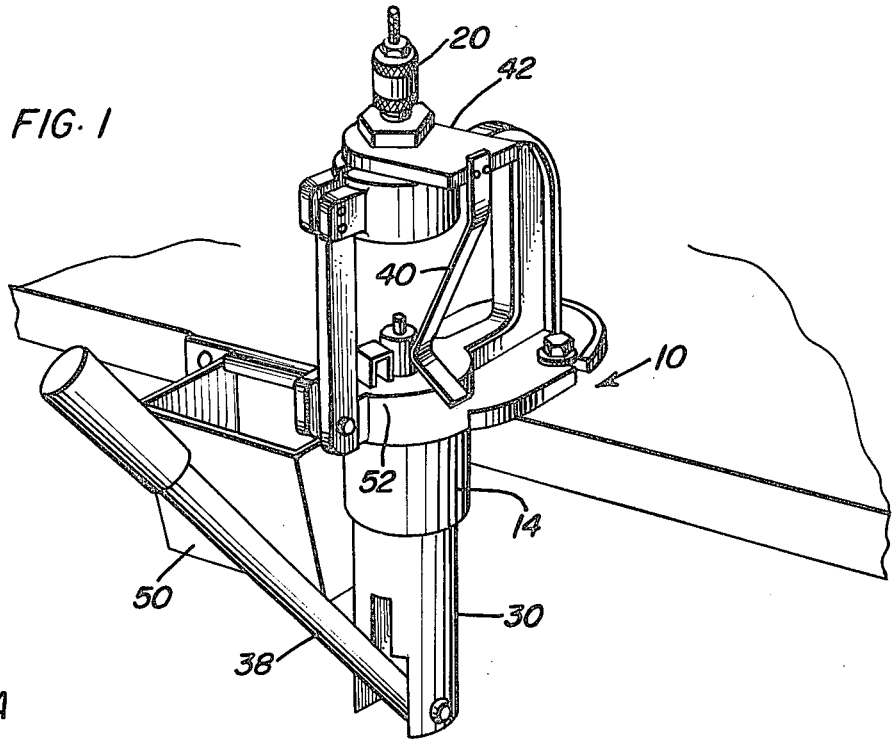
FIG. 1 is a perspective view of a cartridge reloading tool embodying the present invention.
Figure 3:
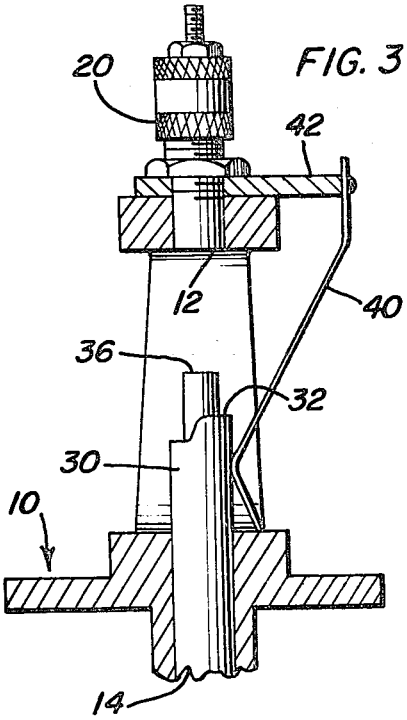
FIG.3 is a vertical, cross-section view, partially cut away, of the cartridge-reloading tool shown in FIG. 1.
Figure 6:
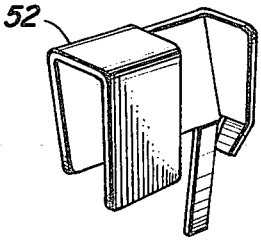
FIG.6 is a perspective view of a shell deflector member
Figure 4:
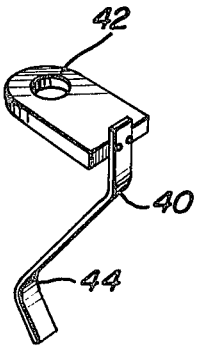
FIG.4 is a perspective view of a preferred leaf spring and mounting bracket.

Referring now to the drawing in FIGS. 1 and 3, a reloading tool is shown, comprising a press frame 10 for reforming spent firearm cartridge shells. Frame member 10 is provided with a lateral access opening and an upper shell-receiving portion 12 which is aligned to receive a shell case 36 being moved vertically upwardly. A lower ram-receiving portion 14 permits up and dowm movement of the reciprocal plunger. A die assembly 20 is mounted on top of the frame 10 adjacent the shell-receiving portion 12. The bidirectional ram 30 is inserted through the lower opening portion 14 of the press frame and is provided with a shell-holding member 32, such as a C-shaped retaining member, which permits lateral movement of a shell case 36. Holding member 32 is open on the side opposite the spring means 40 to permit engagement during the vertical movement of the shell case, while permitting disengagement by a lateral force in the lower ram position. The case may be inserted manually into the retainer portion of the ram. Ram 30 is movable vertically along a travel path to force the shell case 36 into engagement with the die assembly. A bidirectional power delivery means such as a manual lever 38, piston, or motor is provided for moving the ram means upwardly from an intermediate shell-receiving position into an upper die-engaging position.

The improved device is provided with spring means 40 operatively connected to cooperate with movement of the ram or plunger element 30. In the referred embodiment the spring means is a thin, flexible metal leaf spring mounted to the press frame at one end thereof. A mounting bracket 42 is retained by die assembly 20, which may be mounted by threaded mounting means or other suitable connector.

The ejected shells may be caught in a separate chute or basket 50 mounted adjacent to the reloading tool. A suitable container for bench mounting is disclosed in U. S. Pat. No. 3,322,020.

Figure 2A:
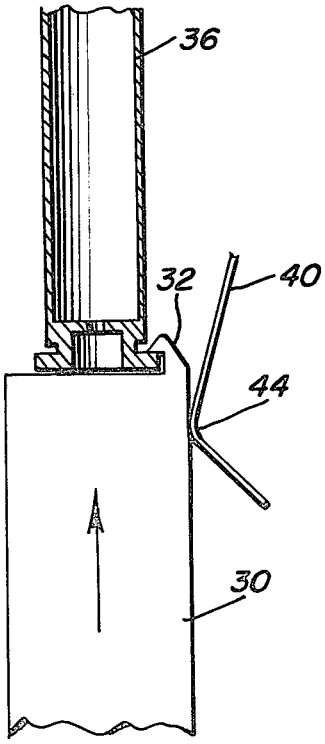
FIG 2A is a schematic diagram showing deflection of the ejection spring means of FIG. 1 during loading.
Figure 2B:
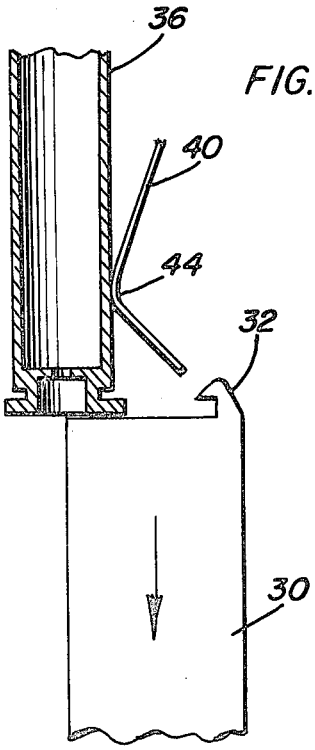
FIG. 2B is a schematic view similar to FIG. 2A showing the shell being ejected from the tool.

Referring now to FIG. 2A, ram member 30 is shown in its intermediate position with cartridge shell 36 being retained thereon. Spring 40 is deflected away from the path of travel of case 36 by contact of curved spring portion 44 with ram 30 during the upward movement of the ram. As shown in FIG. 2B, downward movement of the ram element 30 permits leaf spring 40 to be released therefrom and curved portion 44 moves inwardly to contact the shell 36 and urge the case 36 laterally out of engagement with the ram retainer element 32, thus ejecting the shell from the reloading tool. Leaf spring 40 is retained at one end in a fixed position on mounting bracket 42 by screws or the like.

Figure 5:
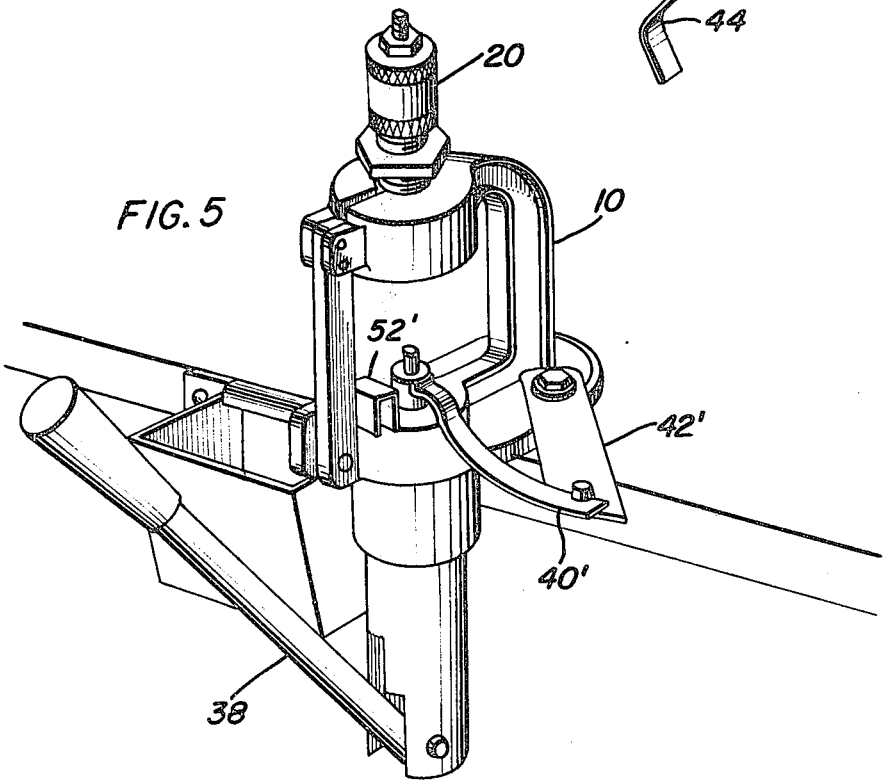
FIG.5 is a perspective view of an alternative embodiment of the invention.

In FIG. 5 an alternative embodiment of the invention is shown wherein the spring means if affixed to the frame at a bottom portion thereof. Mounting bracket 42' is fixed to a bottom portion of frame 10 and disposed to hold leaf spring 40' for deflection into and out of the path of travel of shell 36.

The use of reloading system reduced cartridge case handling substantially, as compared to the completely manual operation. Reduced reloading press time increases the overall efficiency of the reloading operation, in that it eliminates one of the major time-consuming steps—the manual disengagement of the cartridge case from the ram retainer.

Recovery of the spent primer caps may be achieved by any one of several known techniques. As shown in U.S. Pat. No. 3,259,007, a longitudinal passage in the ram permits the disengaged spent cap to drop by gravity. This feature is incorporated in the reloading tool of FIGS. 1 and 5. A cap deflector 52 in FIG. 1 and 52' in FIG. 5 may be attached to the tool frame for directing the spent primer caps toward a basket (not shown). Various deflector mechanisms, such as shown in U.S. Pat. No. 3,320,848, may be substituted for the deflector units disclosed herein, within the inventive concept.

While the invention has been described by reference to certain preferred embodiments, there is not intent to limit the inventive concept thereby.

I claim:

1. A cartridge shell press comprising a frame member having a lateral access opening, an upper shell-receiving portion, and a lower ram-receiving portion, said frame member being adapted to receive a die assembly mounted on said frame adjacent said shell-receiving portion, and aligned to receive a shell member thrust upwardly in said shell-receiving portion;

vertically-movable ram means adapted for moving a shell member along a travel path towards the position of said die assembly and adapted for holding a shell member;

means for moving said ram means upwardly from an intermediate shell engagement position toward an upper die-engaging position and downwardly toward a lower shell ejection position; and spring means extending laterally into the travel path of said shell member, said spring means being deflected outwardly by said ram means in said intermediate shell engagement position and adapted for spring return into said travel path when said ram means is retracted to said lower ejection position, thereby providing positive ejection of a cartridge shell when retracted from the uppper die-engaging position to the lower ejection position.

2. The press of claim 1 wherein said spring means is mounted on said frame member by a mounting bracket operatively disposed between said frame and said die assembly.

3. The press of claim 2 wherein said spring means comprises a leaf spring member attached to said mounting bracket and depending therefrom into said lateral access opening.

4. The press of claim 1 wherein said die assembly is adapted for resizing a cartridge shell and has means for removing a primer cap cooperatively with resizing.

5. The press of claim 4 further comprising a primer cap deflector mounted adjacent said lower ram receiving portion of said frame, said ram means having a passage permitting primer caps to fall from the shell downwardly to said deflector.

6. A cartridge shell press for handling spent firearm cartridge shells comprising a frame member;

a cylindrical ram element positioned at the lower portion of said frame member and adapted to receive and hold a vertically-aligned shell;

means for moving said ram element into an upper position, an intermediate shell-receiving position, and a lower shell-ejecting position; and leaf ejection spring means mounted for lateral deflecting movement by said ram element, whereby said spring means if deflected outwardly by the ram element in said intermediate position and is urged against the shell in said lower position to eject the shell laterally from the ram element.

* * * * *